US008452591B2

(12) United States Patent
Wildfeuer et al.

(10) Patent No.: US 8,452,591 B2
(45) Date of Patent: May 28, 2013

(54) COMFORT NOISE INFORMATION HANDLING FOR AUDIO TRANSCODING APPLICATIONS

(75) Inventors: Herbert Wildfeuer, Santa Barbara, CA (US); Robert Simon, Santa Barbara, CA (US)

(73) Assignee: Cisco Technology, Inc., San Jose, CA (US)

( * ) Notice: Subject to any disclaimer, the term of this patent is extended or adjusted under 35 U.S.C. 154(b) by 997 days.

(21) Appl. No.: 12/101,918

(22) Filed: Apr. 11, 2008

(65) Prior Publication Data

US 2009/0259462 A1 Oct. 15, 2009

(51) Int. Cl.
*G10L 21/02* (2006.01)

(52) U.S. Cl.
USPC ..... 704/226; 704/210; 704/215; 704/227; 704/229

(58) Field of Classification Search
USPC ..... 704/226, 215, 210, 227, 229
See application file for complete search history.

(56) References Cited

U.S. PATENT DOCUMENTS 6,829,579 B2 * 12/2004 Jabri et al. ..... 704/221
7,873,513 B2 * 1/2011 Murgia et al. ..... 704/221
2003/0065508 A1 * 4/2003 Tsuchinaga et al. ..... 704/215
2005/0136900 A1 * 6/2005 Kim et al. ..... 455/414.4
2006/0106598 A1 * 5/2006 Trombetta et al. ..... 704/215
2010/0223053 A1 * 9/2010 Sandgren et al. ..... 704/219

OTHER PUBLICATIONS

"Coding of speech at 8 kbit/s using conjugate-structure algebraic-code-excited liner predication (CS-ACELP)", ITU-T Recommendation G.729 (Jan. 2007).*

R.Zopf; Real-Time Transport Protocol (RTP) Payload for Comfort Noise (CN); Lucent Technologies, Sep. 2002,full copyright The Internet Society 2002; pp. 1-8.

* cited by examiner

*Primary Examiner* — Qi Han
(74) *Attorney, Agent, or Firm* — Brinks Hofer Gilson & Lione

(57) ABSTRACT

A device comprising an audio information processor to receive at least one audio stream encoded according to a first protocol by a remote network processing device, the audio stream having associated comfort noise information to indicate a level of background noise available for presentation during silence periods associated with the audio stream, the audio information processor to decode the received audio stream according to the first protocol and to encode the decoded audio stream according to a second protocol, and a background noise translator to convert the comfort noise information received with the audio stream into a format compatible with the second protocol.

20 Claims, 3 Drawing Sheets

COMFORT NOISE INFORMATION HANDLING FOR AUDIO TRANSCODING APPLICATIONS

FIELD OF THE INVENTION

This invention relates generally to network communications.

BACKGROUND

Many network communication systems facilitate audio or voice calls between network endpoints and often include voice activity detection functionality to detect talk spurts in voice conversations associated with the calls and to discard audio information not associated with the detected talk spurts. When this detected audio data is presented by one of the network endpoints, however, the presence of silence between the talk spurts often causes unanticipated effects on the listener, for example, the listener may believe that the transmission has been lost, the talk spurts may be hard to understand, or the sudden change in sound level can be jarring to the listener. Most network communication systems therefore include comfort noise functionality to provide information that allows network endpoints to fill silence periods with background or comfort noise, thus helping to alleviate these unanticipated effects.

Some network communication systems generate comfort noise with an integrated device, e.g., by integrating voice activity detection, comfort noise generation, and voice data encoding/decoding, while others separate the voice activity detection and comfort noise generation from voice data encoding/decoding. Although both of these device configurations allow the network endpoints to fill silence periods with background noise from the generated comfort noise information, the comfort noise information generated by an integrated device is distinctly different than comfort noise information generated by a separate system.

When network communication systems utilize both types of comfort noise information, for example, during different legs of a call, a gateway implementing separate encoding/decoding and comfort noise generation must rebuild an audio stream by generating background noise from the comfort noise information received from an intergrated device, and then re-detect the generated background noise and re-generate comfort noise information according to the redetected background noise and that is consistent with the separated-configuration of the gateway.

DETAILED DESCRIPTION

Overview

In network communications, a device comprises an audio information processor to receive at least one audio stream encoded according to a first protocol by a remote network processing device, the audio stream having associated comfort noise information to indicate a level of background noise available for presentation during silence periods associated with the audio stream, the audio information processor to decode the received audio stream according to the first protocol and to encode the decoded audio stream according to a second protocol. The device also includes a background noise translator to convert the comfort noise information received with the audio stream into a format compatible with the second protocol. Embodiments will be described below in greater detail.

Description

Figure 1:
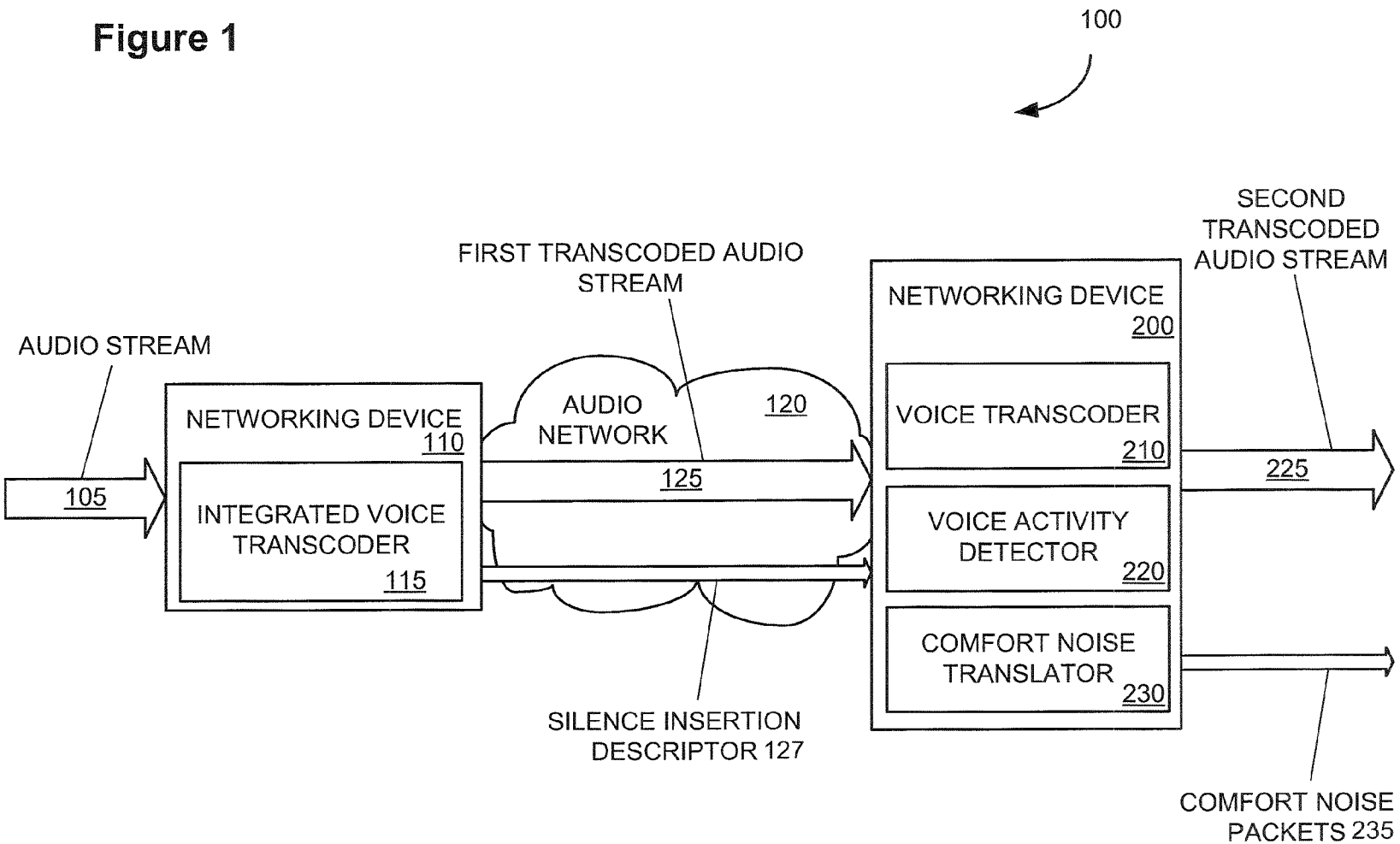
FIG. 1 illustrates an example system implementing comfort noise information translation.

FIG. 1 illustrates an example system 100 implementing comfort noise information translation. Referring to FIG. 1, a network communication system 100 includes a plurality of networking devices 110 and 200 to facilitate audio or voice calls through the network communication system 100. For instance, the networking device 110 may provide audio data to the networking device 200 over an audio network 120 in one leg of a call and then the networking device 200 may send the audio data towards a remote call endpoint (not shown) over a different call leg. The networking devices 110 and 200 may be routers, switches, gateways, or any other device capable of facilitating audio or voice calls through the network communication system 100. The audio network 120 may be a circuit-switched network, a packet-switched network, or any other network or combination of networks capable of exchanging audio data between networking devices 110 and 200.

The networking device 110 may receive an audio stream 105 that may include voice or other audio data associated with a call, and in some embodiments may be encoded according to an encoding scheme or algorithm. The audio stream 105 may, for example, be received from a remote call endpoint (not shown) or another networking device (not shown) over another audio network (not shown). The audio stream 105 may include or be accompanied by comfort noise information (not shown), which may be utilized by the networking device 110 to generate background noise to fill-in silence periods of the audio stream 105.

The networking device 110 includes an integrated voice transcoder 115 or audio information processor to implement multiple integrated audio processing operations, such as audio transcoding, voice activity detection, and comfort noise generation. The integrated voice transcoder 115 may generate a first transcoded audio stream 125 and comfort noise information, such as the Silence Insertion Descriptor 127, from the audio stream 105. The networking device 110 may then send the first transcoded audio stream 125 and comfort noise information, e.g., the Silence Insertion Descriptor 127, to the networking device 200 over the audio network 120. Although FIG. 1 shows the first transcoded audio stream 125 and the Silence Insertion Descriptor 127 sent in different streams, in some embodiments, the Silence Insertion Descriptor 127 may be inserted into, combined with, and/or interleaved in the first transcoded audio stream 125 according to a transmission protocol over the audio network 120.

The integrated voice transcoder 115 may generate the first transcoded audio stream 125 by encoding the audio stream 105 according to an encoding scheme or protocol implemented by networking device 110, e.g., such as standard G.723.1. When the audio stream 105 is received with a previous encoding, the integrated voice transcoder 115 may decode the audio stream 105 according to its previous encoding scheme, prior to encoding the decoded audio stream according to the encoding scheme implemented by networking device 110. In some embodiments, the audio stream 105 may be encoded according to the same or similar encoding scheme implemented by the networking device 110, and thus the networking device 110 may forward the audio data 105 onto the networking device 200 as the first transcoded audio stream 125 without performing at least some of the processing operations.

The integrated voice transcoder 115 may perform voice activity detection operations on the audio stream 105 (or the decoded audio stream) to detect talk spurts and discard audio information not associated with the detected talk spurts. The integrated voice transcoder 115 may generate the comfort noise information, such as the Silence Insertion Descriptor 127, from the audio stream 105. The comfort noise information may describe a background noise level that may be presented during silence periods generated by the voice activity detection and discarding.

The Silence Insertion Descriptor 127 is a type of comfort noise information generated by systems or devices that integrate audio information processing, such as transcoding, and comfort noise generation, such as those implementing standard G.729 annex B and/or standard G.723.1 annex A and/or GSM-EFR/RF/HR DTX. The comfort noise information may describe background noise available for presentation during silence periods associated with the first transcoded audio stream 125 and provide the networking device 200 or another remote call endpoint (not shown) the ability to generate the background noise.

The networking device 200 receives the first transcoded audio stream 125 and the Silence Insertion Descriptor 127 from the networking device 110 over the packet network 120. The networking device 200 may implement a different encoding scheme or protocol than networking device 110, and thus may generate a second transcoded audio stream 225 according to the different encoding scheme and audio data associated with the first transcoded audio stream 125. The networking device 200 also receives the Silence Insertion Descriptor 127 from the networking device 110 and converts or translates the Silence Insertion Descriptor 127 into the comfort noise packets 235 that may accompany the second transcoded audio stream 225 over the next leg of the call.

The networking device 200 has a separated configuration, i.e., including a voice transcoder 210 or audio information processor separate from a voice activity detector 220. The voice transcoder 210 may generate the second transcoded audio stream 225 from the first transcoded audio stream 125, for example, by decoding the first transcoded audio stream 125 and then re-encoding the audio data according to an encoding scheme or algorithm implemented by the networking device 200.

The voice activity detector 220 may perform voice activity detection operations on audio data associated with the first transcoded audio stream 125 to detect talk spurts and discard audio information not associated with the detected talk spurts. Since previous voice activity detection was performed by networking device 110, in some embodiments, the voice activity detector 220 may fine-tune or provide increased granularity to the voice activity detection, while in other embodiments, voice activation operations may be bypassed in networking device 200.

Since the networking device 200 has a separated configuration and thus may implement a different encoding scheme than the networking device 110, the networking device 200 includes a comfort noise translator 230 to directly translate the Silence Insertion Descriptor 127 into comfort noise packets 235 that are compatible with encoding scheme implemented by the networking device 200, e.g. RFC-3389, "Real-time Transport Protocol (RTP) Payload for Comfort Noise (CN)". The comfort noise packets 235 may indicate a background noise-level available for presentation during silence periods associated with the second transcoded audio stream 225.

Since the comfort noise translator 230 may generate the comfort noise packets 235 directly from the Silence Insertion Descriptor 127, the networking device 200 does not have to generate comfort noise from the Silence Insertion Descriptor 127, insert the generated comfort noise into the first transcoded audio stream 125 to rebuild the audio stream 105, and then redetect a background noise level from the rebuilt audio stream 105. In other words, the comfort noise translator 230 may leverage the background noise detection performed by networking device 110 and directly translate or convert comfort noise information, i.e., the Silence Insertion Descriptor 127, into a form that corresponds and/or is compatible with the encoding scheme of the networking device 200. This may allow networking device 200 to increase processing performance and/or efficiency, as well as increase device throughput. Furthermore, generating comfort noise information from regenerated background noise that was detected in an earlier call leg may introduce distortion to the audio data, which can degrade to overall call quality and customer experience.

Figure 2:
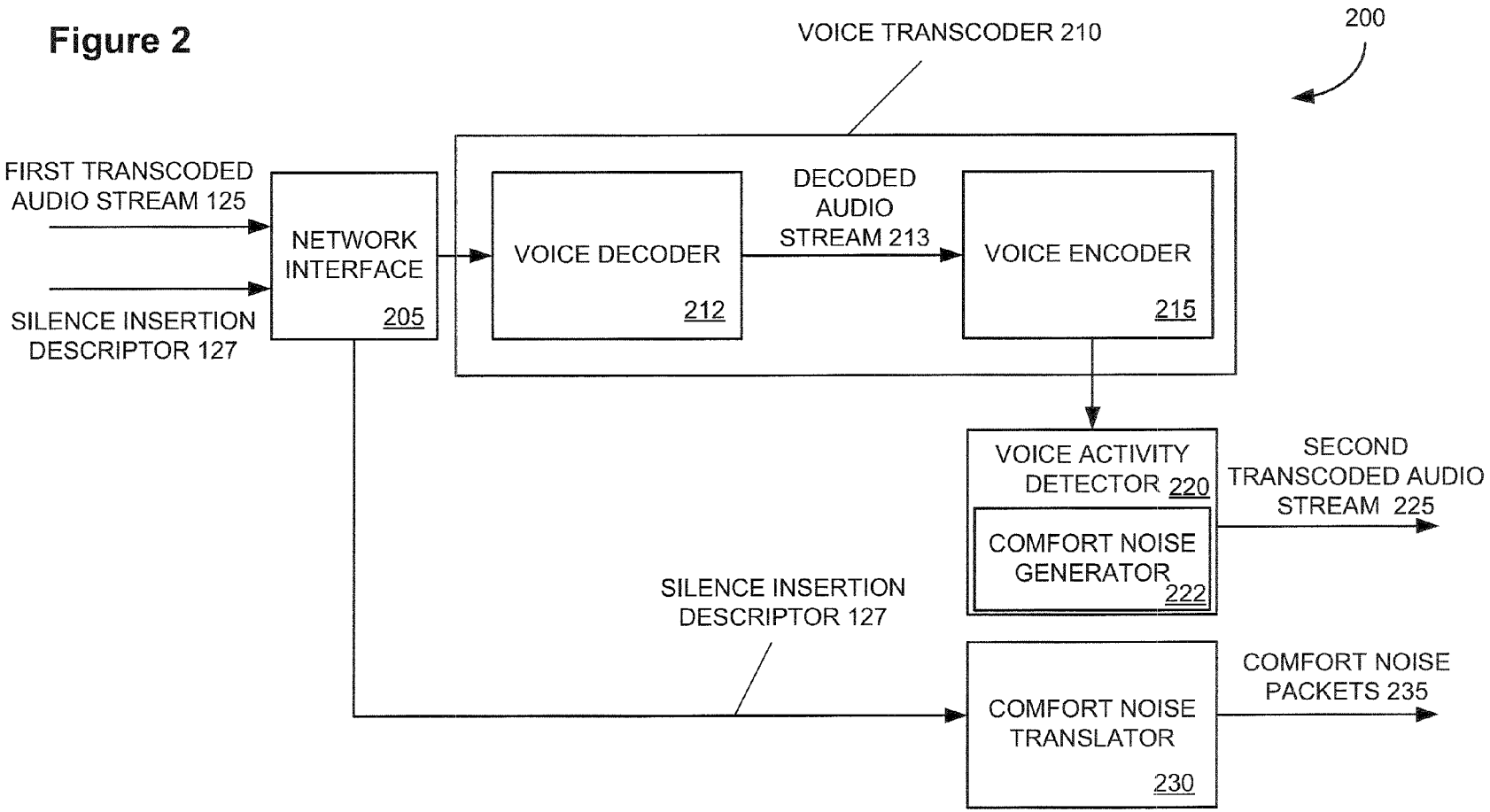
FIG. 2 illustrates example embodiments of a network processing device shown in FIG. 1.

FIG. 2 illustrates example embodiments of a network processing device 200 shown in FIG. 1. Referring to FIG. 2, the network processing device 200 includes a network interface 205 to receive the first transcoded audio stream 125 and the Silence Insertion Descriptor 127 over the audio network 120 (FIG. 1). The network interface 205 may provide the first transcoded audio stream 125 to a voice transcoder 210 to perform transcoding operations on the first transcoded audio stream 125, and provide the Silence Insertion Descriptor 127 to a comfort noise translator 230 for translation into comfort noise packets 235.

The voice transcoder 210 includes a voice decoder 212 to decode the first transcoded audio stream 125 according to the protocol corresponding to its encoding. For instance, when the first transcoded audio stream 125 is encoded according to standard G.723.1, the voice decoder 212 may implement a decoding algorithm according to standard G.723.1 to decode the first transcoded audio stream 125.

The voice transcoder 210 includes a voice encoder 215 to encode a decoded audio stream 213 with an encoding algorithm associated with the networking device 200. In some embodiments, this encoding algorithm scheme may be different than the encoding algorithm implemented by the networking device 110 (FIG. 1).

The network processing device 200 includes a voice activity detector 220 to detect voice activity in the audio stream encoded by the voice transcoder 210. The voice activity detector 200 may perform voice activity detection operations on the encoded audio stream (or in some embodiments the decoded audio stream 213) to detect talk spurts and discard audio information not associated with the detected talk spurts. The voice activity detector 220 may send the second transcoded audio stream 225 towards a remote endpoint (not shown) associated with the call.

In some embodiments, the voice activity detector 220 may include a comfort noise generator 222 to generate comfort noise information from the encoded audio stream (or in some embodiments the decoded audio stream 213). When the networking device 200 receives comfort noise information, such as Silence Insertion Descriptor 127, from a device associated with a previous leg of the call, however, the comfort noise generator 222 may be turn-off or suspended, allowing the comfort noise translator 230 to directly convert the Silence Insertion Descriptor 127 into comfort noise packets 235.

The comfort noise translator 230 may implement a conversion scheme that allows a direct translation of the Silence Insertion Descriptor 127 into comfort noise packets 235. The conversion scheme utilized with G.729 annex B, G.723 Annex A, and GSM algorithms may include, computing the noise level from quantized gain information in the Silence Insertion Descriptor 127, and then converting spectral shape information in the form of quantized Line Spectrum Pair (LSP) coefficients into the reflection coefficients, e.g., when out of band silence information is encoded according to RFC-3389.

A pseudo-code version of this conversion scheme is described below. For example, pseudo-code for a G.729 Annex B conversion between Silence Insertion Descriptor 127 and comfort noise packets 235 may include de-quantizing Energy Information from the Silence Insertion Descriptor 127, e.g., in an approximate decibel (dB) range −12 to 66, and then converting the de-quantized Energy Information from decibels (dB) to a decibel overload (−dBov) format, e.g., through the addition of an offset based on system design. The converted and de-quantized Energy Information is then be quantized, e.g., according to RFC-3389, and may be packed into an RTP packet.

When spectral information in comfort noise packet 235 is desired, conversion scheme may include de-quantizing Line Spectrum Pair (LSP) coefficients from Silence Insertion Descriptor 127, converting the de-quantized LSP coefficients into reflection coefficients, e.g., using a Levinson recursion algorithm, and then quantizing the reflection coefficients, e.g., according to RFC-3389, and packing them into comfort noise packets 235.

In an example pseudo-code format:

E'=de-quantized Energy Information from SID packet, e.g., in a decibel (dB) range of approximately −12 dB to 66 dB).

E"=conversion of E' from decibels dB to decibels overload −dBov, e.g., through addition of offset based on system design.

Quantize E" per RFC-3389 and pack into comfort noise packet.

When converting spectral shape information in the form of quantized Line Spectrum Pair (LSP) coefficients:

LSP'=de-quantized LSP coefficients from SID packet.

RC=conversion of LSP' to reflection coefficients, e.g., using Levinson recursion algorithm.

N1-NM=quantized RC, e.g., according to RFC-3389, reflection coefficients that may be packed into at least one comfort noise packet.

In a more specific example, the transform may be calculated as follows.

Obtain $G_t$, which is the square root of the average energy of a SID frame, from a 5-bit quantized gain $Q(G_t)$ of the Silence Insertion Descriptor frame. This may be performed with a table lookup, for example:

tab_sidgain [32]={2, 5, 8, 13, 20, 32, 50, 64, 80, 101, 127, 160, 201, 253, 318, 401, 505, 635, 800, 1007, 1268, 1596, 2010, 2530, 3185, 4009, 5048, 6355, 8000, 10071, 12679, 15962};

i.e., $G_1$=tab_sidgain[$Q(G_t)$].

Since $G_t$ is the square root of the average energy of a SID frame, the noise level $NL_{-dBov}$ for comfort noise packets in decibel overload −dBov format is $NL_{-dBov}=90-20\log(G_t)$. After determining the $NL_{-dBov}$ and limiting it to a range of (0-127), it may be inserted into one or more comfort noise packets.

An example calculation of the spectral parameters associated with the transform may be performed as follows.

Obtain the Line Spectrum Frequency (LSF) coefficients from the SID packet. In some embodiments, each SID packet may have 10 Line Spectrum Frequency (LSF) coefficients.

Convert the Line Spectrum Frequency (LSF) coefficients into Line Spectrum Pair (LSP) coefficients, e.g., by taking the cosine of the LSF or LSP=cos(LSF).

Convert the LSP coefficients into Linear Predictor coefficients (LPCs), e.g., using a recursive conversion algorithm or technique. For example, by computing $f_1(i)$ for i=1 through 5 as follows:

```
for i=1 to 5
    f1(i) =− 2LSP_{2i−1} f1(i − 1) +2 f1(i − 2) ;
    for j=i−1 to 1
        f1^[i](j) = f1^[i−1](j) − 2LSP_{2i−1} f1^{i−1}(j − 1) + f1^[i−1](j − 2) ;
    end
end
, with initial values f1(0) = 1 and f1(−1) = 0 .
```

Then, computing $f_2$ (i) for i=1 through 5 as follows:

```
for i=1 to 5
    f2(i) =− 2LSP_{2i} f2(i − 1) +2 f2(i − 2) ;
    for j=i−1 to 1
        f2^[i](j) = f2^[i−1](j) − 2LSP_{2i} f2^{i−1}(j − 1) + f2^[i−1](j − 2) ;
    end
end
, with initial values f2(0) = 1 and f2(−1) = 0 .
```

Obtaining $F_1'(z)$ and $F_2'(z)$ by performing a z-transform on $f_1(i)$ and $f_2(i)$ and then multiplying the resulting $F_1(z)$ and $F_2(z)$ by $(1+z^{-1})$ and $(1-z^{-1})$, respectively. Thus, the LPC coefficients may be computed as $0.5\ f_1'(i)+0.5\ f_2'(i)$ for i=1 to 5, and $0.5\ f_1'(11-i)+0.5\ f_2'(11-i)$ for i=6 to 10.

Utilizing the computed LPC coefficients and a Levinson recursion algorithm to compute a Reflection coefficient, which may be quantized uniformly using 8 bits as follows:

RC(quantized)=$(RC+1)/2^8$, where RC(quantized) may be inserted into comfort noise packets, e.g., per RFC 3389.

Figure 3:
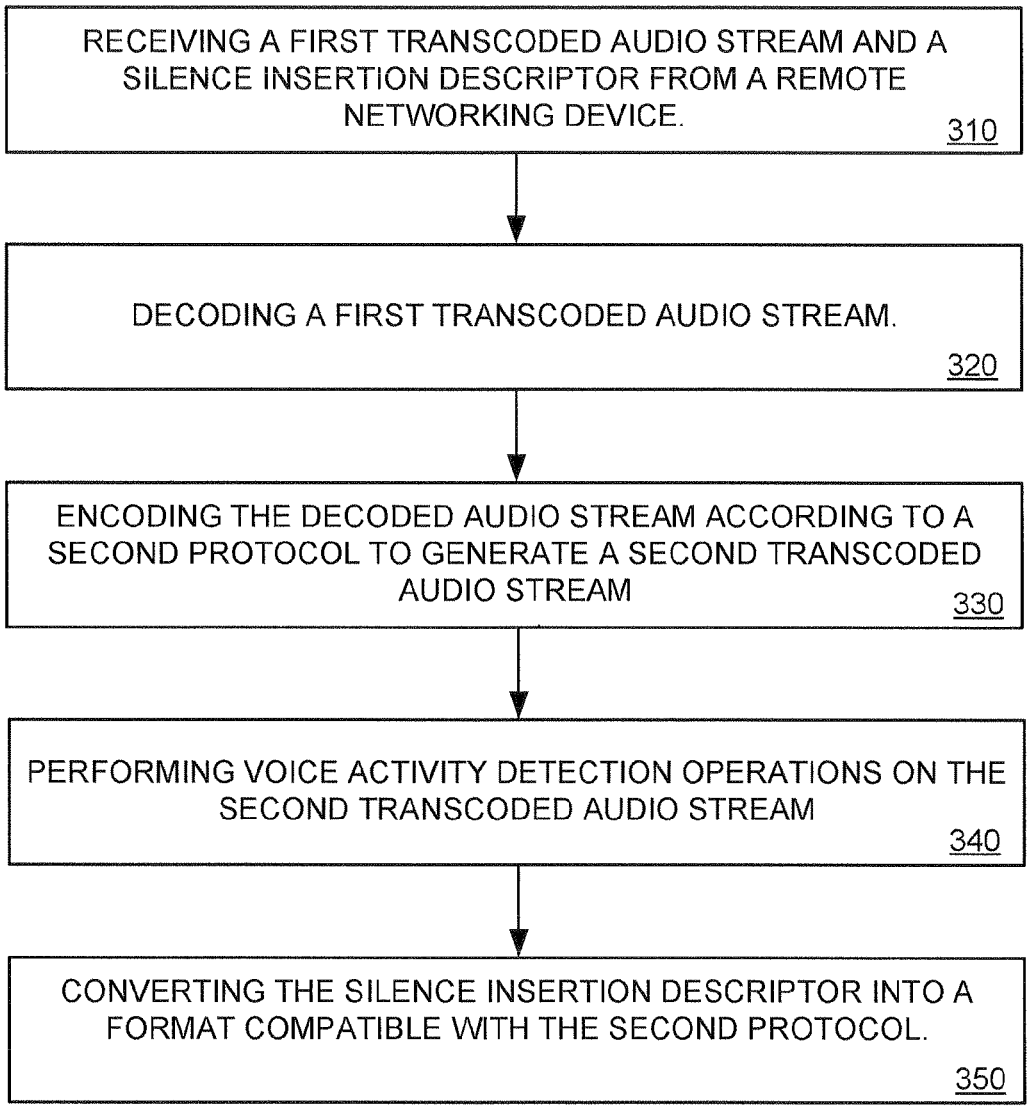
FIG. 3 shows an example method for implementing comfort noise information translation.

FIG. 3 shows an example method for implementing comfort noise information translation. Referring to FIG. 3, the networking device 200 receives a first transcoded audio stream 125 and a Silence Insertion Descriptor 127 from a remote networking device 110 (block 310). In some embodiments, the networking device 200 may decode the first transcoded audio stream 125 according to a first protocol (block 320) and then encode the decoded audio stream according to a second protocol (block 330). The first protocol may correspond to an encoding algorithm implemented by the remote networking device 110 and used to encode the first transcoded audio stream 125. The second protocol may correspond to an encoding algorithm implemented by the networking device 200 and used to encode the decoded audio stream in block 330.

The networking device 200 may perform voice activity detection operations on the second transcoded audio stream 225 (block 340). The voice activity detection operations may detect talk spurts in the audio stream and discard audio information between the detected talk spurts.

The networking device 200 converts the Silence Insertion Descriptor 127 into a format compatible with the second protocol (block 350). In some embodiments, the networking device 200 converts the Silence Insertion Descriptor 127 into comfort noise packets 235 for transmission towards a remote endpoint of the call. By leveraging a previous detection of background noises i.e., in the Silence Insertion Descriptor 127, the networking device 200 may generate comfort noise information that may be transmitted over the next leg of the call without having to redetect background noise associated with the audio stream. This allows for more efficient utilization of processing resources and reduces audio distortion when the audio stream is presented or played-out at a remote endpoint of a call.

One of skill in the art will recognize that the concepts taught herein can be tailored to a particular application in many other advantageous ways. In particular, those skilled in the art will recognize that the illustrated embodiments are but one of many alternative implementations that will become apparent upon reading this disclosure. Although the embodiments described above illustrate a conversion from a silence insertion descriptor to comfort noise packets, the devices and systems may perform translations from comfort noise packets to silence insertion descriptor may be performed or any other comfort noise translation.

The preceding embodiments are exemplary. Although the specification may refer to "an", "one", "another", or "some" embodiment(s) in several locations, this does not necessarily mean that each such reference is to the same embodiment(s), or that the feature only applies to a single embodiment.

The invention claimed is:

1. A device comprising:

an audio information processor to receive a first audio stream encoded according to a first protocol by a remote network processing device and to receive a first comfort noise information to indicate a level of background noise available for presentation during silence periods associated with the first audio stream, where the audio information processor is configured to decode the first audio stream according to the first protocol, and where the audio information processor is configured to encode the decoded first audio stream into a second audio stream according to a second protocol;

a voice activity detector to detect content spurts in the second audio stream;

a comfort noise generator to generate a second comfort noise information from the second audio stream, wherein the second comfort noise information is transmitted with the second audio stream; and a background noise translator to convert the first comfort noise information received with the first audio stream into a third comfort noise information encoded in a format compatible with the second protocol, wherein the device transmits both the second audio stream and the third comfort noise information on separate streams.

2. The device of claim 1 where the first comfort noise information is a Silence Insertion Descriptor generated by the remote network processing device with integrated audio information processing, voice activity detection, and comfort noise generation functionality, and wherein the comfort noise generator is disabled in response to receipt of the first comfort noise information.

3. The device of claim 1 where the background noise translator is configured to de-quantize spectral shape information in the first comfort noise information, compute reflection coefficients encoded according to RFC-3389 from Line Spectrum Pair coefficients corresponding to the de-quantized spectral shape information, and quantize the reflection coefficients for insertion into one or more comfort noise packets.

4. The device of claim 3 where the background noise translator is configured to convert the Line Spectrum Pair coefficients corresponding to the de-quantized spectral shape information into Linear Predictor coefficients and compute the reflection coefficients from the Linear Predictor coefficients utilizing a Levinson recursion process.

5. The device of claim 1, where the background noise translator is configured to de-quantize gain information in the comfort noise information, convert the de-quantized gain information into a decibel overload format, and quantize the de-quantized gain information in the decibel overload format.

6. The device of claim 5 where the de-quantized gain information corresponds to a square-root of the average energy in the first comfort noise information.

7. The device of claim 5 where the background noise translator comprises a lookup table capable of population with multiple de-quantized gain values that are each indexable by the quantized gain information from the first comfort noise information, and where the background noise translator is configured to identify at least one of the de-quantized gain values from the lookup table as the de-quantized gain information based on the quantized gain information.

8. The device of claim 5 where the background noise translator is configured to limit a range of the de-quantized gain information in the decibel overload format and then quantize the de-quantized gain information in the decibel overload format within the range.

9. A method comprising:

decoding at least one first audio stream encoded according to a first protocol by a remote network processing device, the first audio stream having associated first comfort noise information to indicate a level of background noise available for presentation during silence periods associated with the first audio stream;

encoding the decoded first audio stream into a second audio stream according to a second protocol;

detecting talk spurts in the second audio stream and generating a second comfort noise information for the audio information between the talk spurts, wherein the second comfort noise information is transmitted with the second audio stream;

converting the first comfort noise information received with the first audio stream into a third comfort noise information according to a format compatible with the second protocol, where the converting of the first comfort noise information comprises:

de-quantizing spectral shape information in the first comfort noise information, computing reflection coefficients from Line Spectrum Pair coefficients corresponding to the de-quantized spectral shape information, and quantizing the reflection coefficients for insertion into one or more comfort noise packets; and transmitting the second audio stream and the third comfort noise information along distinct paths.

10. The method of claim 9 where the first comfort noise information is a Silence Insertion Descriptor generated by the remote network processing device with integrated audio information processing, voice activity detection, and comfort noise generation functionality, and wherein generating the second comfort noise information is suspended on receipt of the first comfort noise information.

11. The method of claim 9 where the reflection coefficients are compatible with an encoding scheme corresponding to Request For Comment (RFC) 3389, and computing of the reflection coefficients comprises:

extracting Line Spectrum Frequency coefficients from the first comfort noise information;

converting the Line Spectrum Frequency coefficients into Line Spectrum Pair coefficients; and converting the Line Spectrum Pair coefficients corresponding to the de-quantized spectral shape information into Linear Predictor coefficients and computing the reflection coefficients from the Linear Predictor coefficients utilizing a Levinson recursion process.

12. The method of claim 11 where the de-quantizing spectral shape information in the first comfort noise information comprises:

de-quantizing the Line Spectrum Pair coefficients converted from the Line Spectrum Frequency coefficients.

13. The method of claim 9 where the converting of the first comfort noise information comprises de-quantizing gain information in the first comfort noise information, converting the de-quantized gain information into a decibel overload format, and quantizing the de-quantized gain information in the decibel overload format.

14. The method of claim 13 where the converting of the first comfort noise information includes identifying at least one de-quantized gain value from a lookup table as the de-quantized gain information based on the quantized gain information, and where the lookup table is capable of population with multiple de-quantized gain values that are each index able by the quantized gain information from the first comfort noise information.

15. A device comprising:

a background noise translator to convert a first comfort noise information in a Silence Insertion Descriptor packet into a format compatible with one or more comfort noise packets, where the background noise translator is configured to de-quantize spectral shape information in the first comfort noise information, compute reflection coefficients from Line Spectrum Pair coefficients corresponding to the de-quantized spectral shape information, and quantize the reflection coefficients for insertion into the one or more comfort noise packets;

a voice transcoder to convert a first audio stream encoded according to a first protocol into a second audio stream encoded according to a second protocol, wherein the second protocol is compatible with the format of the one or more comfort noise packets; and a voice activity detector to at least one of: pass the second audio stream through without any processing, or, generate a second comfort noise information as part of the second audio stream in response to identification of portions of the second audio stream that contain speech information and portions of the second audio stream that contain silence information, wherein the device transmits the second audio stream from the voice activity detector and the comfort noise packets from the background noise translator on separate paths.

16. The device of claim 15 including a lookup table populated with multiple de-quantized gain values and indexable by quantized gain information in the first comfort noise information, where the background noise translator is configured to identify a de-quantized gain value from the lookup table based on the quantized gain information in the first comfort noise information of the Silence Insertion Descriptor packet, convert the de-quantized gain value into a decibel overload format, and quantize the de-quantized gain value in the decibel overload format to convert the first comfort noise information in the Silence Insertion Descriptor packet into the format compatible with the one or more comfort noise packets.

17. The device of claim 16 where the de-quantized gain value corresponds to a square-root of the average energy in the first comfort noise information.

18. The device of claim 16 where the background noise translator is configured to limit a range of the de-quantized gain value in the decibel overload format and quantize the de-quantized gain value in the decibel overload format within the range.

19. The device of claim 15 where the background noise translator is configured to convert the Line Spectrum Pair coefficients corresponding to the de-quantized spectral shape information into Linear Predictor coefficients and compute the reflection coefficients from the Linear Predictor coefficients utilizing a Levinson recursion process.

20. The device of claim 15 where the background noise translator is configured to extract Line Spectrum Frequency coefficients from the first comfort noise information, convert the Line Spectrum Frequency coefficients into the Line Spectrum Pair coefficients, and de-quantize the Line Spectrum Pair coefficients converted from the Line Spectrum Frequency coefficients.

* * * * *